US008814580B2

(12) United States Patent
Shen et al.

(10) Patent No.: US 8,814,580 B2
(45) Date of Patent: Aug. 26, 2014

(54) CARD EDGE CONNECTOR

(71) Applicant: Hon Hai Precision Industry Co., Ltd., New Taipei (TW)

(72) Inventors: Xue-Hai Shen, Kunshan (CN); Zhuang-Xing Li, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/631,873

(22) Filed: Sep. 29, 2012

(65) Prior Publication Data

US 2013/0084723 A1 Apr. 4, 2013

(30) Foreign Application Priority Data

Sep. 30, 2011 (CN) ..... 2011 2 0373352

(51) Int. Cl.
*H01R 13/62* (2006.01)

(52) U.S. Cl.
USPC ..... 439/157; 439/160

(58) Field of Classification Search
USPC ..... 439/152–160, 326–328, 372
See application file for complete search history.

(56) References Cited

U.S. PATENT DOCUMENTS

| | | | | | |
|---|---|---|---|---|---|
| 4,898,540 | A * | 2/1990 | Saito | 439/153 |
| 5,468,156 | A * | 11/1995 | Flinchbaugh et al. | 439/157 |
| 5,584,705 | A * | 12/1996 | Lin | 439/157 |
| 5,609,493 | A * | 3/1997 | Cheng et al. | 439/157 |
| 5,676,561 | A * | 10/1997 | Chiang | 439/328 |
| 6,802,732 | B1 * | 10/2004 | Bu et al. | 439/328 |
| 6,979,206 | B2 * | 12/2005 | Bu et al. | 439/79 |
| 7,789,681 | B2 * | 9/2010 | Guan et al. | 439/157 |
| 7,934,936 | B2 * | 5/2011 | Yang | 439/157 |
| 8,337,215 | B2 * | 12/2012 | Yu | 439/59 |
| 2008/0318448 | A1 * | 12/2008 | Ringler et al. | 439/78 |

* cited by examiner

*Primary Examiner* — Thanh Tam Le
(74) *Attorney, Agent, or Firm* — Wei Te Chung; Ming Chieh Chang

(57) ABSTRACT

A card edge connector 100 includes an elongated insulative housing 1, a plurality of contacts 2 retained in the housing 1 and a pair of latches 3 pivoted on the housing 1. The housing 1 has an elongated central slot 12 for receiving a daughter card 200. The latch 3 has a locking head 36 to lock the daughter card 200 for preventing the daughter card 200 from escaping out of the central slot 12 in a mating direction. An end of the locking head 36 has a bump 360 passing through the daughter card 200 to abut against an outside surface of the daughter card 200.

13 Claims, 5 Drawing Sheets

CARD EDGE CONNECTOR

BACKGROUND OF THE INVENTION

1. Field of the Invention

The present invention generally relates to a card edge connector and more particularly to a card edge connector with a latch.

2. Description of Related Art

U.S. Pat. No. 7,934,936, issued on May 3, 2011, discloses a related card edge connector which includes an elongated housing, a plurality of contacts retained in the housing and a pair of latches pivoted on two opposited ends of the housing. The housing includes two pairs of pivoting holes and an elongated central slot for receiving a daughter card. The central slot opens forwardly so that the daughter card inserts therein along a front-to-rear direction. Each latch has a base portion, a locking head extending downwardly from a front end of the base portion, an ejecting portion extending downwardly from a rear end of the base portion and a pair of pivots pivoting on the pivoting holes of the housing. When the daughter card inserts into the central slot of the card edge connector, the daughter card rearwardly presses the ejecting portion to make the latch rotate downwardly, in this process, the locking head passes through a notch of the daughter card. When the daughter card arrives its final position, the locking head abuts against with an inner wall of the notch along a front-to-rear direction to prevent the daughter card from escaping out of the central slot. However, as a result of the daughter card parallel to a printed circuit board, to which the card edge connector is mounted, the daughter card may swing downwardly when the daughter card is affected by its own gravity or when the card edge connector is shocked by an outside force.

Hence, an improved card edge connector is desired to overcome the above problems.

SUMMARY OF THE INVENTION

According to one aspect of the present invention, a card edge connector, adapted for receiving a daughter card is formed with an elongated insulative housing, a plurality of contacts retained in the housing and a pair of latches pivoted on the housing. The housing has an elongated central slot for receiving the daughter card. The latch has a locking head to lock with the daughter card to prevent the daughter card from escaping out of the central slot in a mating direction. An end of the locking head has a bump for passing through the daughter card to abut against with an outside surface of the daughter card.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
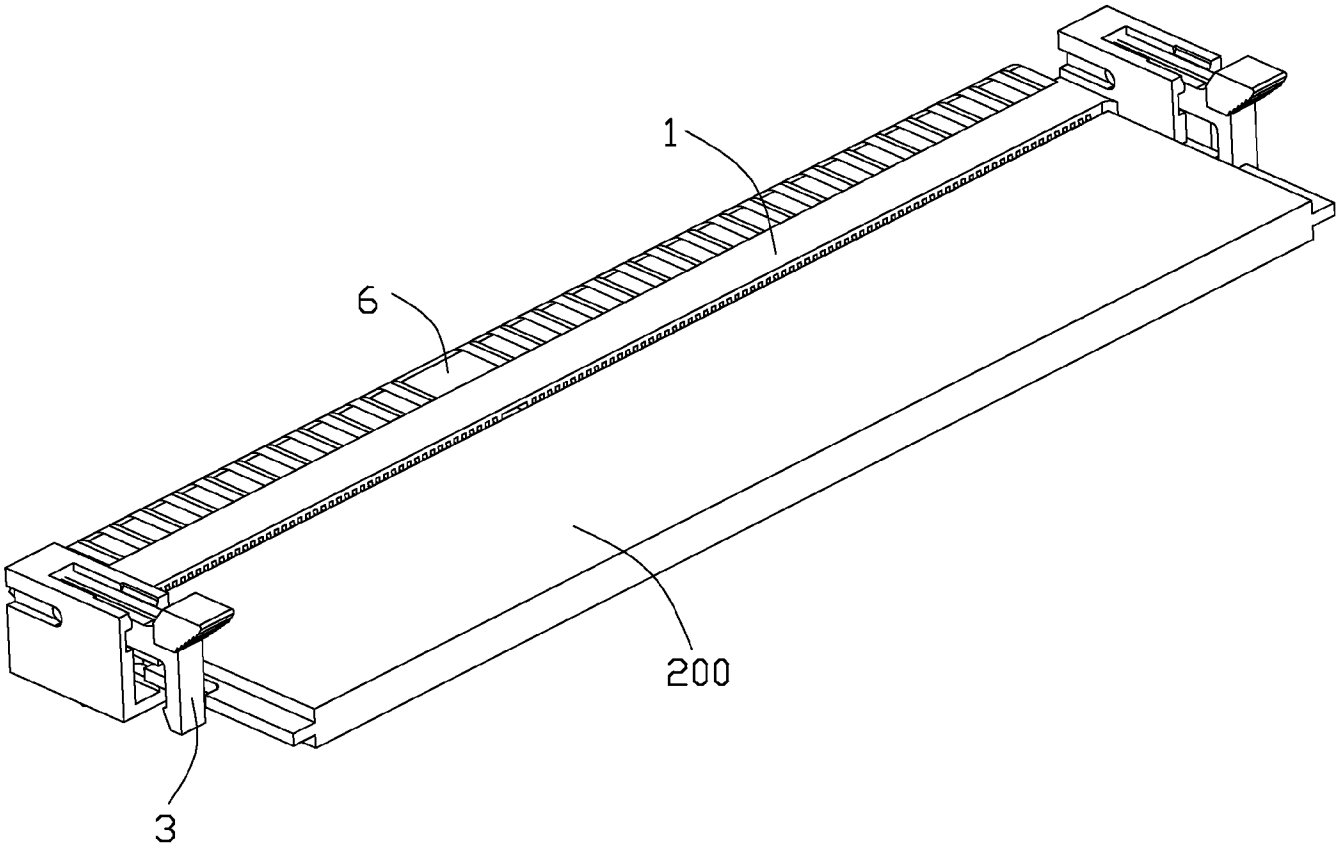
FIG. 1 is an assembled, perspective view of a card edge connector and a daughter card inserted into the card edge connector.

Reference will be made to the drawing figures to describe the present invention in detail, wherein depicted elements are not easily shown to scale and wherein like or similar elements are designated by same or similar reference numeral through the several views and same or similar terminology.

Figure 2:
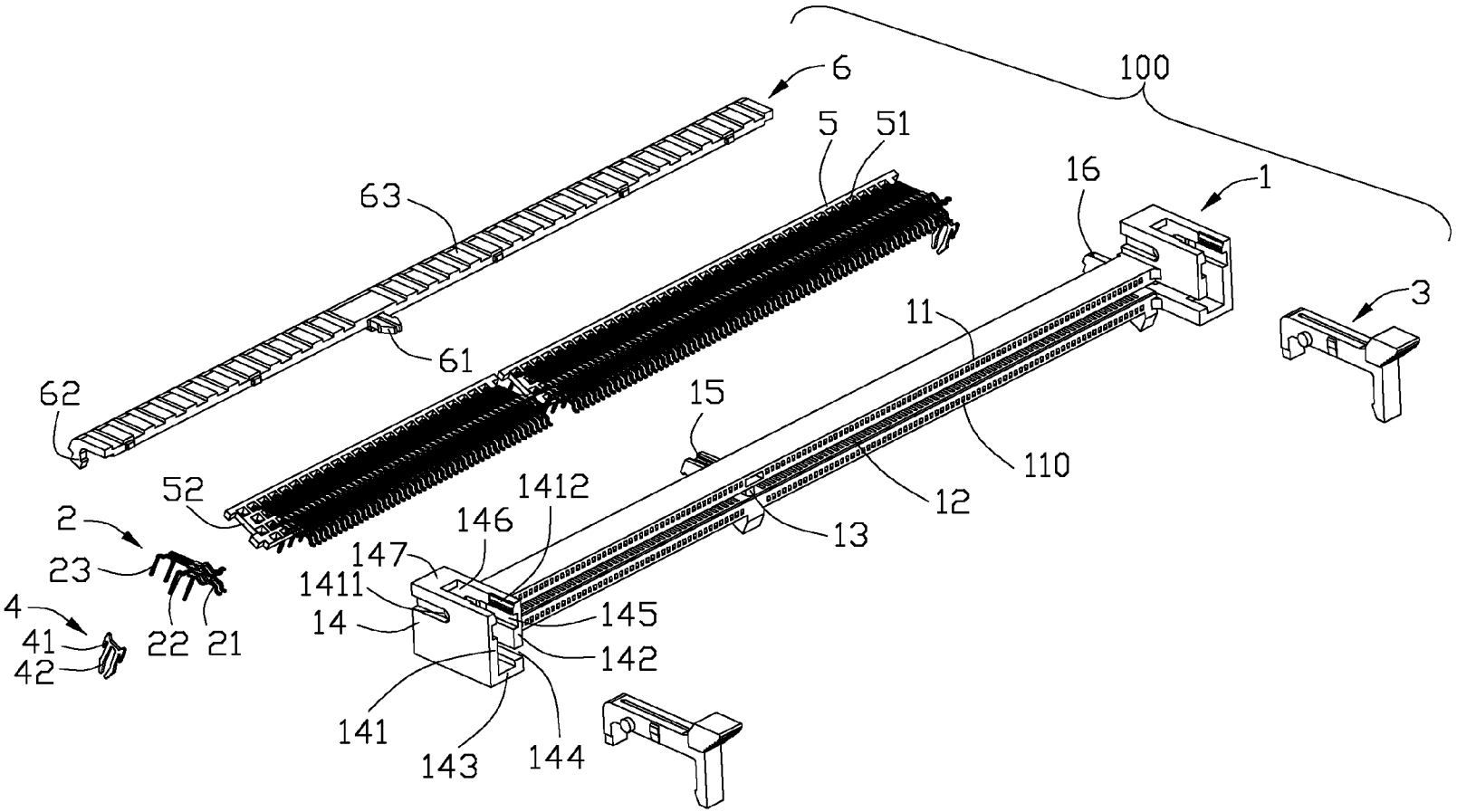
FIG. 2 is an explored, perspective view of the card edge connector according to a preferred embodiment of the present invention.

Referring to FIG. 1 and FIG. 2, a slanted type card edge connector 100 in a preferred embodiment according to present invention is disclosed and adapted for accommodating a daughter card 200. The card edge connector 100 comprises an elongated insulative housing 1, a plurality of contacts 2 retained in the housing 1, a pair of latches 3 pivoted on the housing 1, two spacers 5 and a pair of board lockers 4 mounted on a bottom of the housing 1 to latch with a printed circuit board (not shown) and a cover 6 mounted on a rear side of the housing 1.

Referring to FIG. 2, the card edge connector 100 is mounted on the printed circuit board at a certain degree, the housing 1 has a pair of longitudinal sidewalls 11, a central slot 12 formed between the sidewalls 11, two towers 14 disposed on two longitudinal ends of the central slot 12 and a key 13 formed in the central slot 12 to divide the central slot 12 into two different parts with different lengths so as to prevent the daughter card 200 from mismating. The sidewalls 11 define a plurality of contact passageways 110 communicating with the central slot 12 to receive the contacts 2, respectively. The housing 1 further has a retaining cavity 15 located on a rear side of the housing 1 and a pair of first tubers 16 protruding rearwardly from two opposite ends of the housing 1. An opening of the central slot 12 slants upwardly so that the daughter card 200 can be inserted into the central slot 12 aslant.

Referring to FIG. 2, each tower 14 has an outside wall 141, an inner wall 142 corresponding to the outside wall 141 along a longitudinal direction of the housing 1, a connecting wall 143 connecting with the outside wall 141 and the inner wall 142, and a rear wall 147 opposited to the connecting wall 143. The inner wall 142 has a clipping slot 144 for clipping the daughter card 200. The tower 14 defines a receiving cavity 146 surrounded by the outside wall 141, the inner wall 142, the connecting wall 143 and the rear wall 147. The outside wall 141 and the inner wall 142 have two opposite channels 145 respectively, two obstruct portions 1412 located on an outside of the channel 145 respectively and two pivoting holes 1411 to assemble the latch 3. The receiving cavity 146 extends through a top surface of the rear wall 147, the clipping slot 144 communicates with the receiving cavity 146 and the central slot 12.

Referring to FIG. 2, the contact 2 has a retaining portion 22 retained in the passageway 110, a contacting portion 21 extending into the central slot 12 from one end of the retaining portion 22 to contact with the daughter card 200 and a soldering leg 23 extending downwardly beyond the housing 1 from the other end of the retaining portion 22.

Figure 3:
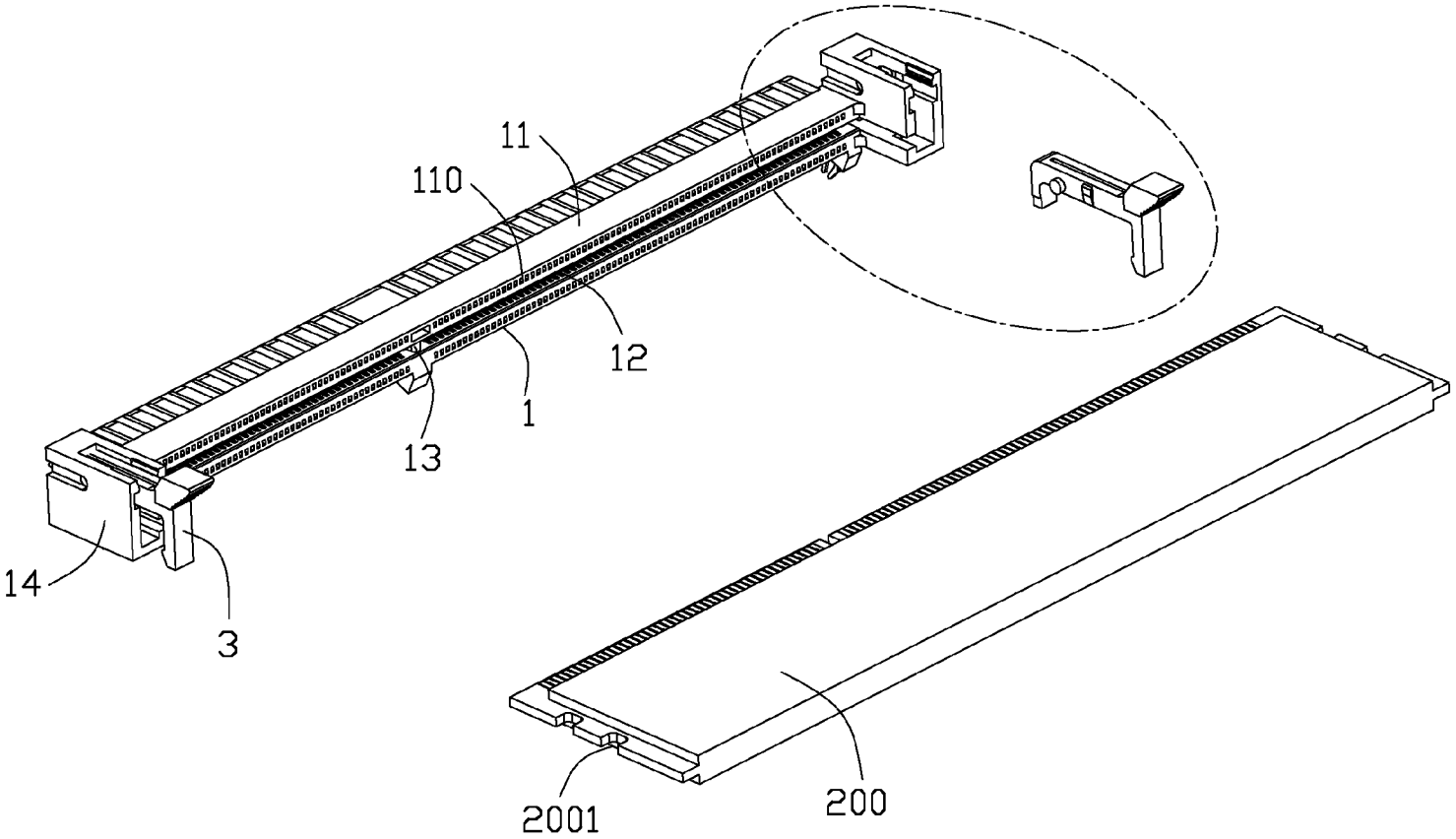
FIG. 3 is a partially exploded view of the card edge connector and the daughter card ejected from the card edge connector.
Figure 4:
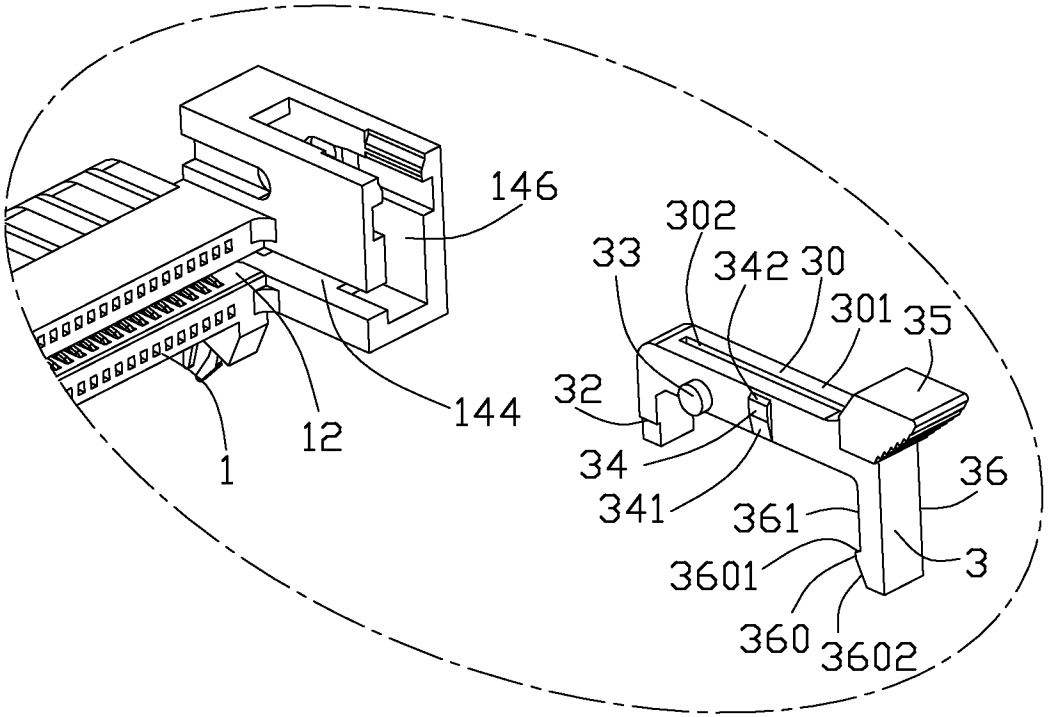
FIG. 4 is a partially enlarged view of a circle part in FIG. 3.

Referring to FIGS. 3 to 4, the latch 3 has a base portion 30, a locking head 36 extending vertically along an up-to-down direction from a front end of the base portion 30, an operating portion 35 extending upwardly from the front end of the base portion 30 and an ejecting portion 32 extending downwardly from a rear end of the base portion 30 to lift up the daughter card 200. The base portion 30 includes a pair of elastic walls 301, a slit 302 formed between the elastic walls 301, two pivots 33 and two protrusions 34 located on two outer lateral sides thereof. The locking head 36 has a locking surface 361, a bump 360 located on a bottom end of the locking surface 361 and protruding toward the ejecting portion 32. The bump 360 has a pushing surface 3601 and a guiding surface 3602. The pushing surface 3601 Perpendicular to the locking surface 361 so that the locking head 36 can lock the daughter card 200 effectively, the guiding surface 3602 extendes downwardly and forwardly from the pushing surface 3601 to guide the locking head 36 passing through a notch 2001 of the daughter card 200 and formed an obtuse angle therebetween to make the daughter card 200 be locked in the card edge connector 100 or be ejected out of the card edge connector 100 easily. The protrusion 34 has a clined surface 341 extending toward the central slot 12 and a right angle surface 342 far away from the central slot 12. The locking head 36 is located in front of the tower 14.

Referring to FIG. 2, the board locker 4 comprise a securing portion 41 retained in the housing 1 and a pair of legs 42 extending downwardly from the securing portion 41 to lock with the printed circuit board.

The spacer 5 defines a plurality of through holes 51 for receiving corresponding soldering leg 23 of the contacts 2 and a pair of depressions 52 located on two opposite ends thereof.

Referring to FIG. 2 and FIG. 3, the cover 6 assembled to the rear side of the housing 1 has a main body 63, a locking portion 61 extending forwardly from the main body 63 and a pair of second tubers 62 extending downwardly from two opposite ends of the main body 63. The locking portion 61 is received in the retaining cavity 15 of the housing 1 and interference fit with the retaining cavity 15, the first tuber 16 and the second tuber 62 are commonly assembled in the depression 52 of the spacer 5, for this reason, the housing 1, the spacer 5 and the cover 6 are fixed together stably. The soldering leg 23 passes through the through hole 51 of the spacer 5, the cover 6 is located on the rear side of the housing 1 for covering a part of the retaining portion 22 which is exposed in the rear side of the housing 1.

Figure 5:
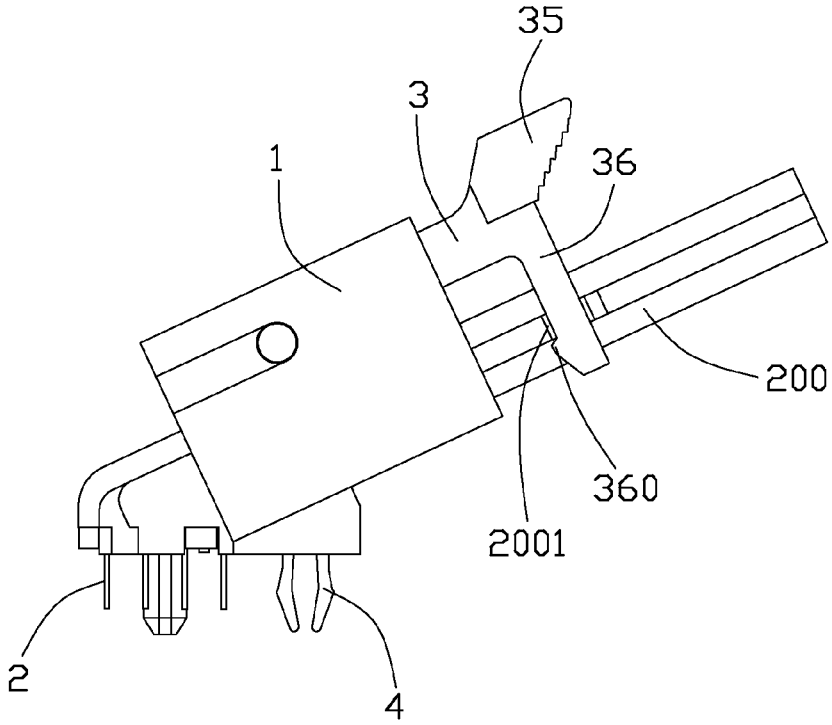
FIG. 5 is a left side view of the card edge connector as shown in FIG. 1.

Referring to FIG. 2 and FIG. 4, the latch 3 is received in the receiving cavity 146 of the tower 14. When the daughter card 200 inserts into the central slot 12 of the card edge connector 100, two opposite edges of the daughter card 200 insert in the receiving cavities 146 through the clipping slot 144, and the daughter card 200 presses the ejecting portion 32 rearwardly to make the latch 3 rotate downwardly. In this process, the guiding surface 3602 guides the locking head 36 pass through the notch 2001 of the daughter card 200 and the clined surface 341 and the obstruct portion 1412 abut against each other to push the elastic wall 301 of the latch 3 deflect inwardly, the outside wall 141 and the inner wall 142 of the tower 14 deflect outwardly so as to make the protrusion 34 enter the channel 145. Referring to FIG. 5, when the daughter card 200 arrives its final position, the locking surface 361 of the locking head 36 rearwardly abuts against a rear bottom corner of the notch 2001 to prevent the daughter card 200 from forwardly escaping out of the central slot 12 and the pushing surface 3601 also support upwardly the daughter card 200 to prevent the daughter card 200 from swing downwardly. In addition to, the right angle surface 342 of the protrusion 34 abuts against the obstruct portion 1412, so that a needed force to open the latch 3 is bigger than a force to close the latch 3, to avoid the latch 3 are opened easily. When withdrawn the daughter card 200 from the card edge connector 100, the latch 3 is rotated upwardly and the ejecting portion 32 lift up the daughter card 200, by such a way that the daughter card 200 leaves away from the central slot 12.

The locking head 36 has the bump 360 for upwardly supporting the daughter card 200 when the daughter card 200 arrives its final position to avoid the daughter card 200 to swing downwardly, even if the daughter card 200 is affected by its own gravity or the card edge connector 100 is shocked by an outside force. It is noted that in the embodiment the receiving slot defines a width dimensioned in snug compliance with a thickness of the daughter card. The locking head is directed downwardly when the latch is located at the lower locking position. Moreover, an upper face of the tower forms an opening upwardly communicating the receiving cavity with the exterior so as to allow the elongated base portion of the corresponding latch to extend therethrough upwardly when said latch is located at the upper unlocking position understandably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated insulative housing having an elongated central slot for receiving a daughter card and at least one tower located on one end thereof, the tower has an outside wall, an inner wall corresponding to the outside wall along the longitudinal direction of the housing, a connecting wall, and a rear wall opposite to the connecting wall, the tower defining a receiving cavity surrounded by the outside wall, the inner wall, the connecting wall and the rear wall, the receiving cavity passing through the rear wall in an up-to-down direction, the inner wall having a clipping slot communicating with the receiving cavity and the central slot to clip the daughter card, the outside wall connecting with the connecting wall and the rear wall to prevent the daughter card from moving outwardly in a longitudinal direction;

a plurality of contacts retained in the housing; and at least one latch received in the receiving cavity of the housing and rotating around an axis extending along the longitudinal direction, the latch having a locking head to lock with a notch of the daughter card so as to prevent the daughter card from escaping out of the central slot along a mating direction; wherein the locking head has a bump at a free end thereof, which is used for passing through the notch of the daughter card to abut against the daughter card, the bump has a pushing surface abutting against an outside surface of the daughter card to prevent the daughter card from swinging and a guiding surface extending outwardly from the pushing surface, the guiding surface extend downwardly and forwardly from a rear end of the pushing surface to form an acute angle with the pushing surface so as to guide the locking head passing through the notch of the daughter card easily; and wherein the housing further includes two spacers located on a bottom side thereof and a cover, the cover is assembled to the rear side of the housing, each spacer defines a plurality of through holes, each contact has a retaining portion retained in the housing, a soldering leg extending downwardly beyond the housing from the retaining portion and being received in the through hole, a part of the retaining portion which is exposed in the rear side of the housing is covered by the cover.

2. The card edge connector as claimed in claim 1, wherein the latch comprises a base portion, the locking head extends vertically along an up-to-down direction from a front end of the base portion.

3. The card edge connector as claimed in claim 2, wherein the latch further has an operating portion extending upwardly from the front end of the base portion and an ejecting portion extending downwardly from a rear end of the base portion to lift up the daughter card, the bump protrudes toward the ejecting portion.

4. The card edge connector as claimed in claim 2, wherein the locking head has a locking surface, the bump is located on the locking surface, when the daughter card is inserted into the central slot, the locking head gets into the notch of the daughter card and the locking surface abuts against an inner wall of the daughter card along a front-to-rear direction to prevent the daughter card from escaping out of the central slot.

5. A card edge connector for use with a card type module with a pair of notches at two opposite sides, comprising:

an insulative housing defining a receiving slot extending in a longitudinal direction and forwardly communicating with an exterior in a roughly front-to-back direction perpendicular to the longitudinal direction, said receiving slot defining a width dimensioned in snug compliance with a thickness of the module for receiving therein the module in roughly a lying manner with upper and bottom surfaces opposite to each other in a thickness direction of the module which is perpendicular to both said longitudinal direction and said roughly front-to-back direction;

a plurality of contacts disposed in the housing with contacting sections exposed into the receiving slot;

a pair of latches mounted at two opposite ends of the housing for respective engagement with the corresponding notches, one each of said latches being pivotal, between an upper unlocking position and a lower locking position, relative to the housing about an axis extending said longitudinal direction; and each of the latches defining an elongated base portion with thereof an ejection portion at a rear end for abutment with a bottom edge of the module and a locking head at a front end for latchable engagement within the corresponding notch of the module, the locking head directed downward when the latch is located at the lower locking position; wherein the housing includes a pair of opposite upper and lower sidewalls commonly defining said receiving slot exactly therebetween in the thickness direction of the module, a pair of towers located at two opposite ends of the housing, each of the towers defining a receiving cavity to receive the corresponding latch therein; wherein each of said towers defines an upper face with therein an opening upwardly communicating the receiving cavity with the exterior so as to allow the elongated base portion of the corresponding latch to extend therethrough upwardly when said latch is located at the upper unlocking position; wherein the locking head defines a bulge for upwardly abutting against the bottom surface of the module around the corresponding notch when said latch is located at the lower locking position so as to limiting further downward movement of the module relative to the housing; and wherein said bulge defines an asymmetrical configuration with a short pushing surface for locking the module and a large guiding surface for guiding the locking head through the corresponding notch during locking.

6. The card edge connector as claimed in claim 5, wherein said bulge faces rearward when said one of the latches is located at the lower locking position.

7. The card edge connector as claimed in 5, wherein said housing is equipped with a tuber to lift up the housing in an oblique state so as to have said lying manner essentially oblique correspondingly.

8. The card edge connector as claimed in claim 5, wherein said one of the latches defines a base portion located between the front end and the rear end and extending in said front-to-back direction while the locking head and the ejection portion extend in the thickness direction, when said one of the latches is located at the lower locking position.

9. The card edge connector as claimed in claim 5, wherein the tower defines a height dimensioned essentially twice that of other portions of the housing defined by said upper and lower sidewalls in the thickness direction of the module.

10. The card edge connector as claimed in claim 5, wherein the upper sidewall is roughly located at a mid-level of the tower in the thickness direction of the module.

11. The card edge connector as claimed in claim 5, wherein each of said latch includes an operation portion located, in the thickness direction of the module, above the upper face of the corresponding tower for easy accessibility.

12. The card edge connector as claimed in claim 5, wherein the latch defines a pivotal axis which is located at a level higher than that of the receiving slot.

13. The card edge connector as claimed in claim 5, wherein the latch is pivotal about a pivotal axis which extends along said longitudinal direction.

* * * * *